US005921661A

United States Patent [19]

Eusterbrock et al.

[11] Patent Number: 5,921,661

[45] Date of Patent: Jul. 13, 1999

[54] AUTOMATIC BULB SHUTOFF SYSTEM FOR LIGHTING FIXTURES

[75] Inventors: Paul W. Eusterbrock, Minneapolis, Minn.; Bernd Swolinski, Bennighausen; Willi Brinkmann, Lippstadt IV, both of Germany

[73] Assignee: Holtkotter International, Inc., South St. Paul, Minn.

[21] Appl. No.: 08/882,605

[22] Filed: Jun. 25, 1997

Related U.S. Application Data

[51] Int. Cl.[6] ..... F21V 25/12

[52] U.S. Cl. ..... 362/276; 362/394; 362/802; 323/221

[58] Field of Search ..... 362/394, 395, 362/276, 802, 410, 414; 323/221; 250/250, 341.1

[56] References Cited

U.S. PATENT DOCUMENTS 4,415,952 11/1983 Hattori et al. ..... 362/276

5,528,448 6/1996 Brenner et al. ..... 362/276

5,733,038 3/1998 Wang ..... 362/276

*Primary Examiner*—Thomas M. Sember

*Attorney, Agent, or Firm*—Craig J. Lervick

[57] ABSTRACT

A control system is provided for use in conjunction with a lighting fixture which will provide additional safety by avoiding the risk of fire. The safety system provides a number of sensors which are capable of detecting the presence of objects in close proximity to the lighting element and appropriately switching power off when such objects are detected. The actual detection is accomplished by use of a plurality of infrared sensors which create an infrared shield around the bulb of the lighting fixture and insure no objects intrude upon the shielded space while the lighting system is in operation.

23 Claims, 5 Drawing Sheets

AUTOMATIC BULB SHUTOFF SYSTEM FOR LIGHTING FIXTURES

BACKGROUND OF THE INVENTION

The present invention relates to a safety device for use with lighting fixtures. More specifically, the present invention provides a safety shutoff system for use with lighting fixtures which avoids dangerous situations which could cause fires.

As is well known, lighting bulbs tend to become very hot during use. Consequently, care must be taken to appropriately shield from this heating. This is particularly true in lighting fixtures which utilize halogen lighting elements. Should flammable materials come close to, or in contact with these bulbs, a real fire danger is created. The consequences of such a fire would be catastrophic resulting in harm to property and even the risk of death.

Typically, shielding or protecting from the heat created by lighting bulbs has been accomplished by providing appropriate lamp shades or lamp coverings so as to avoid contact between the bulb and other elements. Alternatively, shielding has been accomplished by providing a bulb enclosure which completely surrounds the light bulb itself thus avoiding any contact. This shielding or protection is not always effective as the shield itself tends to absorb heat. Care must then be taken to protect from contact with both the shield and the bulb so as to avoid risk of fire.

Previous methods of shielding from the heat of the bulb have been ineffective for a number of additional reasons. From a lighting perspective, it is undesirable to place elements in front of the light bulbs. Obviously, these elements, despite their physical makeup, will absorb some light and reduce the amount of light provided. Additionally, the need for shields or shades drastically limits the design flexibility in developing the lighting system. In order to create a shield which appropriately protects from the bulb and also does not itself become dangerously hot, a fairly large structure is necessary. Consequently, alternative protection methods are necessary whenever a fairly sleek and compact lighting fixture is desired.

In attempting to avoid the risk of fire danger, the reduction or elimination of heat in the bulb itself is not a viable option. As is well known, it is necessary for the bulb to be as efficient as possible at producing usable light. With today's lighting technology, this requires the use of higher power levels which necessarily generate both light and heat.

As can be expected, any contact with objects which are even remotely flammable can be very dangerous. For example, any contact between the light bulb and draperies or fabrics can potentially cause eruption into flames. Consequently, this entire situation must be avoided. Further, an active approach to avoiding the risk of fire is more desirable as these lighting fixtures are typically unattended. For example, lights are occasionally left on and windows are occasionally left open. It is not uncommon for draperies to be blown close to or in contact with the lighting fixture. If active protection from this threat of fire is included within the fixture, a much safer situation is created.

SUMMARY OF THE INVENTION

The present invention provides for a safety system which will automatically shut off the lighting system when foreign objects come dangerously close to the light element. For example, should the wind blow draperies dangerously close to the light, the system of the present invention will cause power to be removed, thus avoiding any further danger of flames.

The automatic shutoff operation of the present invention is accomplished using a plurality of infrared emitter and detector pairs to create a "sensor shield" which completely surrounds the lighting element. More specifically, infrared light beams are directed between each emitter/detector pair. Related circuitry can then be used to determine if the infrared beam is being disrupted. By positioning multiple emitter/detector pairs in appropriate locations, the infrared beams will completely surround the lighting element. Consequently, these emitter/detector sets are capable of sensing the presence of any object in close proximity to the lighting element. Further, once these objects are removed the control system of the present invention allows power to be reapplied to the lighting element. This allows full operation of the light so long as no objects are present adjacent to the lighting element while also providing a safety shutoff.

It is an object of the present invention to provide a lighting system which itself avoids the risk of fire danger when objects come in close proximity to the lighting element. This is accomplished by providing active sensors which detect the presence of objects in close proximity to the light and consequently shuts the light off.

It is an object of the present invention to provide a safety system which will cause a light bulb to automatically shut off when objects are detected in close proximity to the light itself. The safety system will be fast acting and efficient by using infrared light.

It is another object of the present invention to provide a detection system utilizing infrared detector and emitter pairs which will surround the lighting element of a light fixture. Consequently, when the infrared beams connecting this emitter-detector pair are broken by objects, the light fixture will automatically shut off. Consequently, the lighting element will not generate undesirable heat, thus eliminating the risk of fire.

It is a further object of the present invention to provide a lighting controller which will avoid the risk of fire hazard by automatically shutting off when foreign objects are detected in close proximity to the lighting element.

BRIEF DESCRIPTION OF THE DRAWINGS

Further objects and advantages of the present invention can be seen by reading the following detailed description in conjunction with the drawings in which.

DETAILED DESCRIPTION OF THE INVENTION

Figure 1:
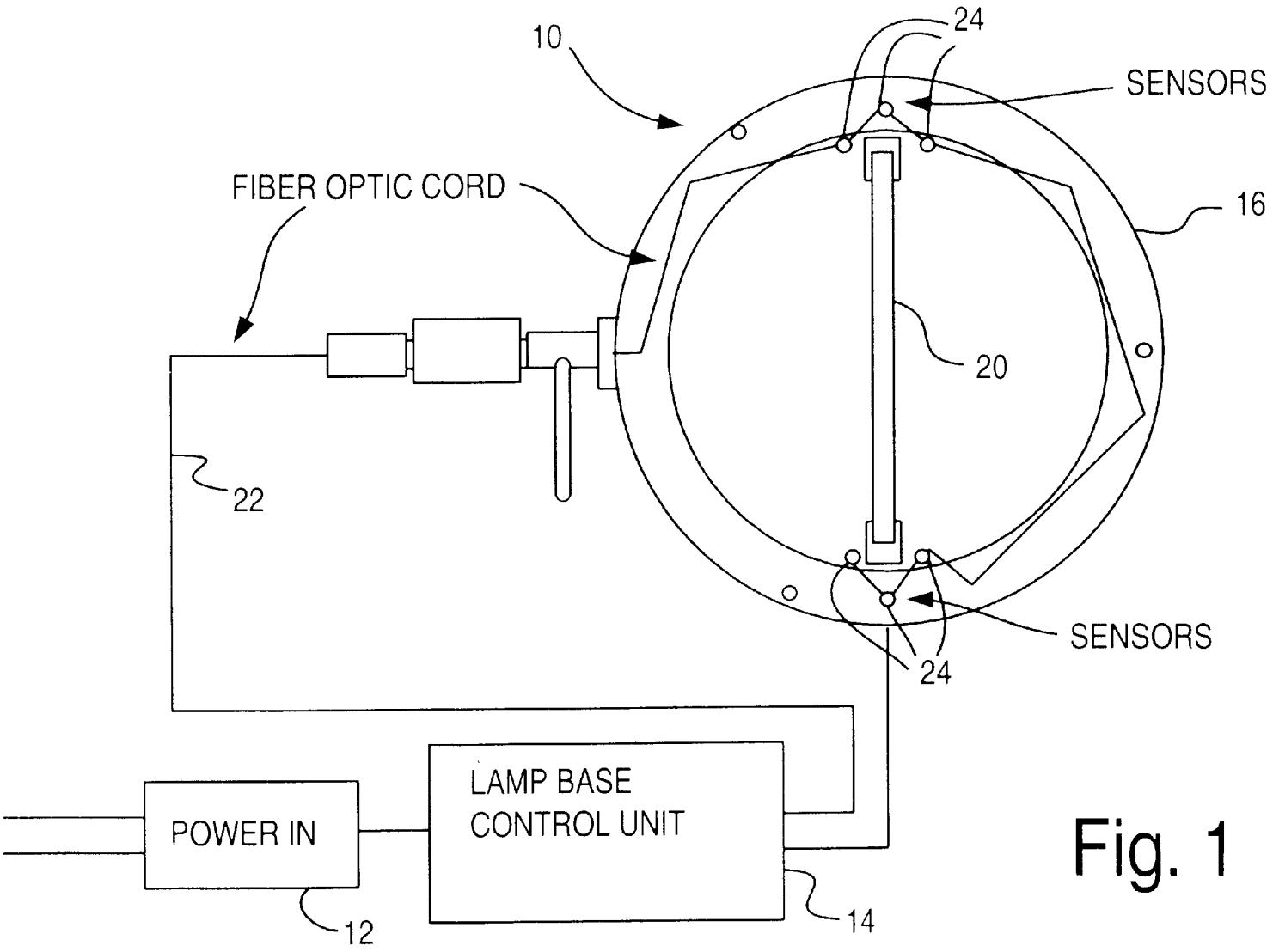
FIG. 1 is a block diagram illustrating the elements of the present invention.

Referring now to FIG. 1, there is shown a block diagram illustrating the parts of the present invention. More specifically, FIG. 1 includes a light fixture 10 along with a power supply 12 and a control unit 14. As is typical, light fixture 10 includes a housing 16 which surrounds and holds a bulb 20. Housing 16 further includes accommodations to provide power to bulb 20 such that the system is capable of providing light. More specifically, electrical power is typically passed through the bulb allowing illumination of a gas or a filament, depending upon the type of bulb used.

As is also well known, bulb 20, while receiving electrical energy, can get very hot. Heat generated by bulb 20 is then capable of igniting other objects such as draperies, clothing, furniture, etc. There is a serious danger of fire whenever objects come into close proximity with bulb 20. The present lighting system also includes an automatic bulb shutoff safety system to protect from the possibility of fire when objects become close to bulb 20. More specifically, the safety system includes control unit 14, fiber-optic cable 22 and a plurality of sensors 24 which will cause power to be removed from element when objects are detected in close proximity to bulb 20.

Figure 2:
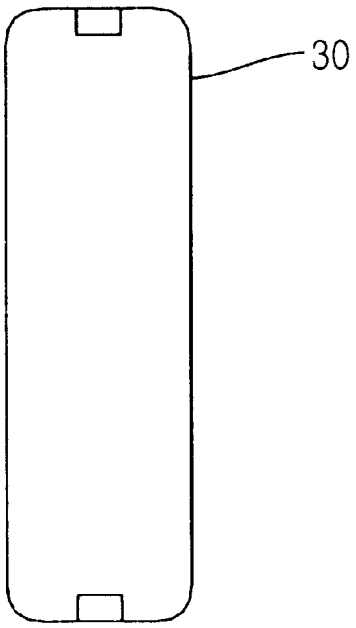
FIG. 2 is a bottom view of the lighting shield utilized in the present invention.

In one embodiment of the present invention, bulb 20 is an elongated halogen bulb spanning a considerable length of housing 16. Placed over and substantially surrounding one side of bulb 20 is a shield 30 which has a substantially concave interior surface. Shield 30 provides a first level of protection for bulb 20 (i.e. it protects from direct contact between foreign objects and bulb 20). The configuration of shield 30 and its placement in relation to bulb 20 can be better seen by referring to FIGS. 2 and 3 which show the shield in top and side view. As can be seen, bulb 20 is positioned on the concave side of shield 30.

Figure 3:
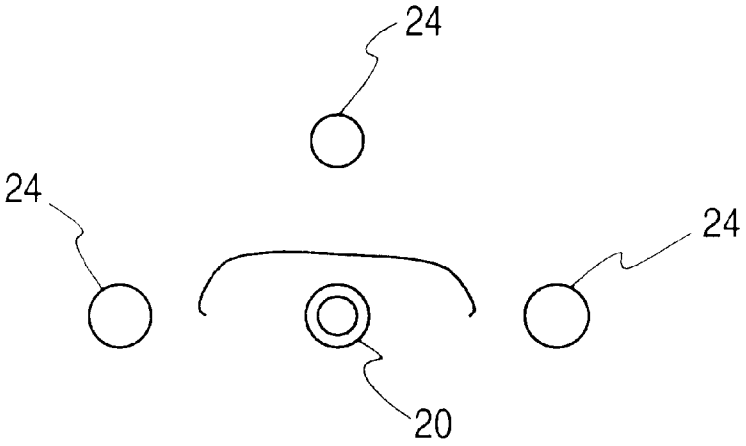
FIG. 3 is an end view of the lighting element and adjacent components.

Referring now specifically to FIG. 3, there is shown one embodiment of the positioning of sensor pairs 24 in relation to shield 30 and bulb 20. As stated, bulb 20 is positioned on the concaved side of shield 30. Sensors 24 are thus positioned to create an infrared enclosure protection field or safety grid around shield 30. Typically these sensor pairs 24 are made up of infrared emitter/detector pairs such that one sensor will emit an infrared beam whereas a second sensor will then be used for detecting that signal. For example, a photoelectric sensor could be used similar to the HPX Series Photoelectric Sensor/Control manufactured and sold by Honeywell MicroSwitch. Related circuitry can then detect whether the infrared beam has been broken. By utilizing a plurality of sensor pairs 24, shield 30 can be completely surrounded by infrared beams.

Figure 6:
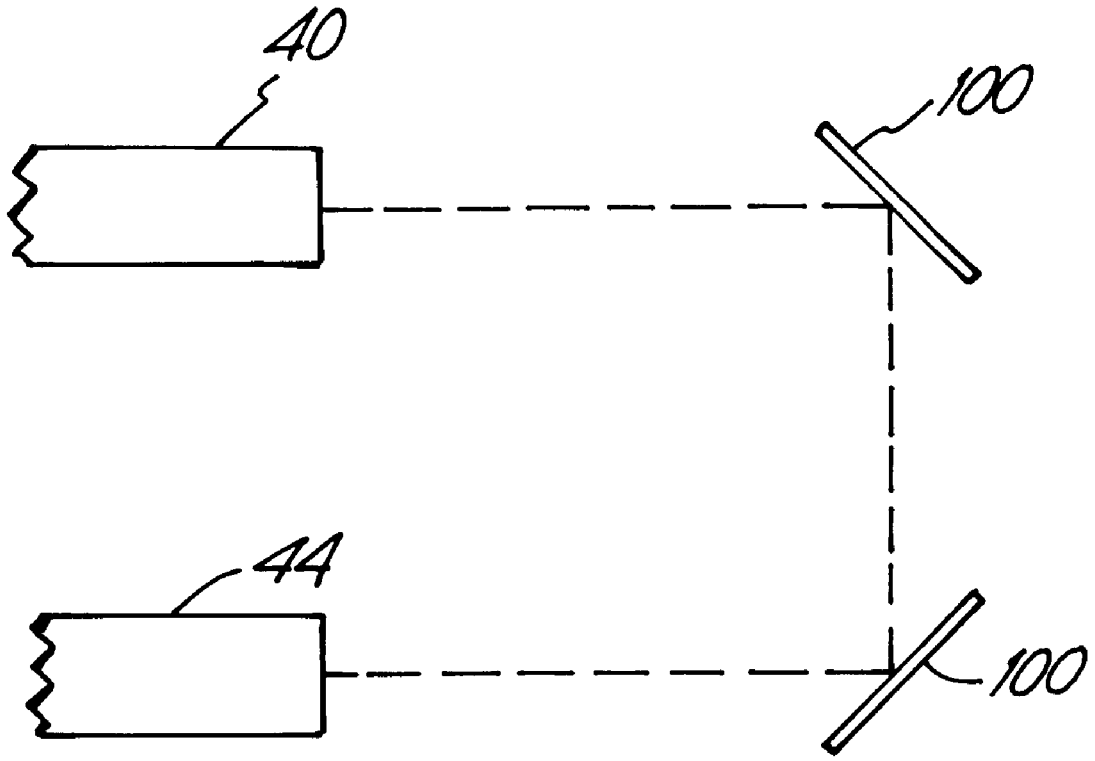
FIG. 6 is a schematic drawing illustrating the operation of an emitter/detector with a plurality of mirrors.

It will be understood that several variations are possible for sensor 24. For example, referring to FIG. 6, a system utilizing a plurality of mirrors 100 could be used wherein the infrared beams are appropriately reflected along a predetermined path. In this case, any disruption in the continuous infrared beam could still be detected. Additionally, alternative detection signals could be used to completely surround the bulb. For example, light signals of virtually any preselected frequency spectrum could be used.

The important feature of the present lighting system is its capability to sense the presence of objects in close proximity to the bulb. Also, it is important that the system them be able to react to the detection of objects by removing power from the bulb, thus eliminating the dangers of fire. While optical systems have been described for use in detection of objects, it is understood that alternative detection systems are equally capable. For example, alternative detection systems may include other optical systems, sonar detectors, motion detectors, etc.

In operation, control unit 14 provides an infrared signal at an output to fiber-optic cable 22. Fiber-optic cable 22 then carries these infrared signals to sensor pairs 24. These sensors then produce the infrared enclosure which is configured to completely surround bulb 20 and housing 30. As previously stated, sensor pairs 24 includes emitter-detector pairs. By cooperating with one another, these emitter-detector pairs provide an unbroken infrared signal therebetween. However, should an object of any type break or disrupt this uninterrupted signal, control unit 14 will detect this disruption and cause power to be removed from bulb 20. This removal of power will cause the bulb to shut off and thus eliminate any further generation of heat by bulb 20. Consequently, this risk of fire is eliminated.

Figure 4:
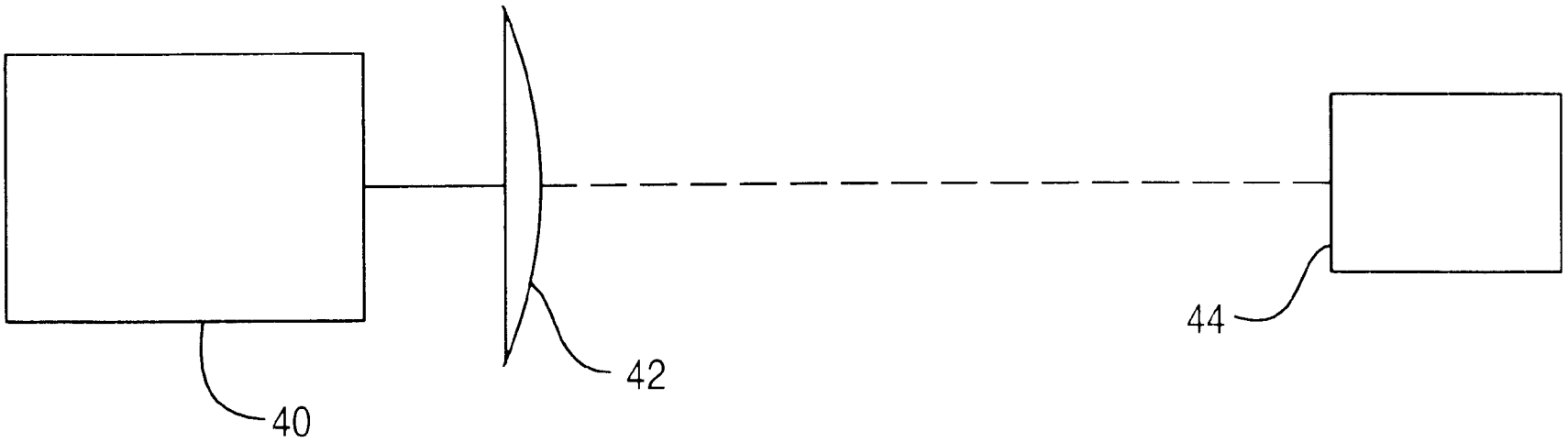
FIG. 4 is a schematic drawing illustrating the operation of the emitter/detector pairs.

As previously mentioned, sensors 24 include emitter-detector pairs which cooperate to maintain an unbroken signal therebetween. Referring now to FIG. 4 there is shown a more detailed illustration of this principal. More specifically, each emitter 40 is provided with a lens 42 for appropriately directing the infrared signals. This signal is then directed towards receiver 44 for receipt thereby. Alternatively, each receiver 44 could easily be configured to receive signals from a plurality of emitters 40. Further, the lens could be configured in any number of ways to appropriately direct these infrared signals.

Figure 5:
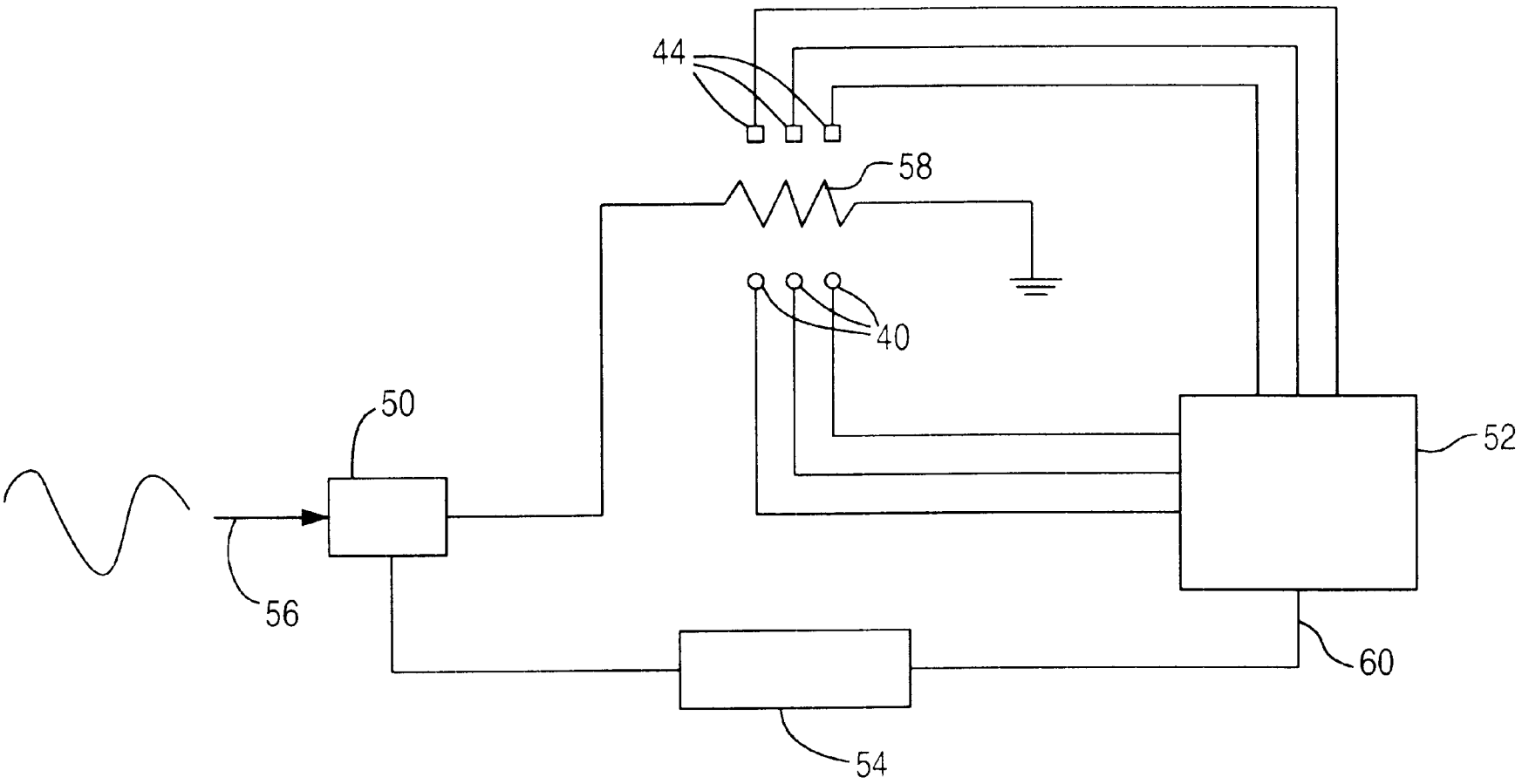
FIG. 5 is a block diagram illustrating the operation of the control circuitry.

To better understand the operation of the present invention, a schematic diagram is shown in FIG. 5. In this Figure, the actual control and switching operations are shown which accomplish the sensing and power removal of the present invention. More specifically, the control device includes a power switching control 50, a sensor monitor 52, and a main controller 54.

In operation, line power or main power is received by power switching control 50 at an input 56. Power switching control 50 includes mechanisms such as relays to pass this power on to bulb 20. In the diagram of FIG. 5, bulb 20 is simply represented as a resistor 58. It is clearly understood that lighting elements may have other characteristics than simple resistance; however, for purposes of this description, further elaboration upon the bulb characteristics themselves are unnecessary.

Switching controller 50 also receives an input from main controller 54. The main controller includes logic circuitry to indicate whether conditions are safe for bulb operation. Consequently, this circuitry is capable of controlling whether power will be directed toward main bulb 20 or not.

As previously referenced, the present invention includes a plurality of emitter/detector pairs for sensing the presence of foreign objects in close proximity to the bulb. These pairs are shown as emitter 40 and receiver 44 in FIG. 5. In this embodiment, three emitter/receiver pairs are shown in close proximity to bulb resistor 58. Each of these emitter/receiver pairs are monitored by sensor monitor 52. In summary, when an unbroken infrared signal is being passed between each emitter/detector pair, sensor monitor 52 provides an output signal on its condition output 60 indicative of the safe operation of the bulb. Alternatively, if the infrared beam between the emitter/sensor pair is broken, sensor monitor 52 produces a signal on condition output 60 indicating that unsafe operating conditions have been detected. Main controller 54 can then react to these conditions and have power removed from bulb 20 by appropriately switching power switching controller control 50. In this way, the safe operation of the lighting fixture is achieved.

Having illustrated and described the principles of the invention in the preferred embodiment, it should be apparent to those skilled in the art that the invention can be modified in arrangement and detail without departing from such principles. We claim all modifications coming within the scope and spirit of the following claims.

It is claimed:

1. A safety system for use with a lighting fixture which provides light to an area wherein the safety system prevents the danger of fire caused by heat generated by a lighting bulb within the lighting fixture, the safety system comprising:

a power switching device attached to a main power supply for receiving a main power signal and controlling whether or not the main power signal is passed to a power output;

a detector positioned adjacent to the lighting bulb for creating a protection field surrounding and in close proximity to the lighting bulb and detecting the presence of an object in close proximity to the lighting bulb and providing a signal at an output indicative of the presence of the object when the protection field is disrupted; and a safety controller attached to the output of the detector for receiving the signal from the detector indicating that the object is present in close proximity to the bulb, the safety controller also having an output attached to the power switching device, wherein the safety controller output will direct the power switching device to remove power from its output when the detector detects the object in close proximity to the bulb.

2. The lighting fixture of claim 1 wherein the power switching device is a relay.

3. The lighting fixture of claim 1 wherein the detector further comprises a plurality of infrared detectors which produce the protection field surrounding the lighting bulb.

4. The lighting fixture of claim 1 wherein the detector further comprises an infrared signal source and a plurality of mirrors for creating a set of infrared beams which form the protection field around the lighting bulb.

5. A safety lighting system which provides light to an area while also protecting from the danger of fire caused by heat generated by a lighting bulb, the fixture comprising:

a lighting fixture for holding and appropriately positioning the lighting bulb so as to cast light in a desired manner;

a power switching device attached to a main power supply for receiving a main power signal and controlling whether or not the main power signal is passed to a power output, the power output being attached to the lighting bulb so as to cause the bulb to be illuminated; and a detection system attached to the lighting fixture, the detection system including a plurality of sensing elements positioned adjacent to the lighting bulb for detecting the presence of objects in close proximity to the lighting bulb by creating a protection field surrounding a portion of the lighting bulb and producing a signal at a plurality of sensing element outputs when the protection field is disrupted, the detection system also including a safety controller attached to the plurality of sensing element outputs for receiving the signal from the detector indicating that the object is present in close proximity to the bulb, the safety controller also having an output attached to the power switching device, wherein the safety controller output will direct the power switching device to remove power from its output when the detector detects the object in close proximity to the bulb.

6. The lighting fixture of claim 5 wherein the power switching device is a relay which passes power to the bulb when no objects are detected by the detection system and which removes power from the bulb when objects are detected by the detection system.

7. The lighting fixture of claim 5 wherein the detector further comprises a plurality of infrared detectors which produce the protection field surrounding the lighting bulb.

8. The lighting fixture of claim 5 wherein the detector further comprises an infrared signal source and a plurality of mirrors for creating a set of infrared beams which form the protection field around the lighting bulb.

9. A lighting fixture for providing light to an area while also protecting from the danger of fire caused by heat generated by a lighting bulb, the fixture comprising:

a power switching device attached to a main power supply for receiving a main power signal and controlling whether or not the main power signal is passed to a power output;

a detection system positioned adjacent to the lighting bulb for detecting the presence of objects in close proximity to the lighting bulb and providing a signal at an output indicative of the presence of the object, wherein the detection system further includes a plurality of infrared detectors which produce an infrared shield surrounding the lighting bulb; and a safety controller attached to the output of the detector for receiving the signal from the detector indicating that the object is present in close proximity to the bulb, the safety controller also having an output attached to the power switching device, wherein the safety controller output will direct the power switching device to remove power from its output when the detector detects the object in close proximity to the bulb.

10. The lighting fixture of claim 9 wherein the power switching device is a relay.

11. A lighting fixture for providing light to an area while also protecting from the danger of fire caused by heat generated by a lighting bulb, the fixture comprising:

a power switching device attached to a main power supply for receiving a main power signal and controlling whether or not the main power signal is passed to a power output;

a detector positioned adjacent to the lighting bulb for detecting the presence of objects in close proximity to the lighting bulb and providing a signal at an output indicative of the presence of the object, wherein the detector further includes an optical signal source and a plurality of mirrors for creating a set of infrared beams which surround the lighting bulb; and a safety controller attached to the output of the detector for receiving the signal from the detector indicating that the object is present in close proximity to the bulb, the safety controller also having an output attached to the power switching device, wherein the safety controller output will direct the power switching device to remove power from its output when the detector detects the object in close proximity to the bulb.

12. The lighting fixture of claim 11 wherein the power switching device is a relay.

13. A safety lighting fixture for providing light to an area while also protecting from the danger of fire caused by heat generated by a lighting bulb, the fixture comprising:

a lighting fixture for holding and appropriately positioning the lighting bulb so as to cast light in a desired manner;

a power switching device attached to a main power supply for receiving a main power signal and controlling whether or not the main power signal is passed to a power output, the power output being attached to the lighting bulb so as to cause the bulb to be illuminated; and a detection system attached to the lighting fixture, the detection system including a plurality of sensing elements positioned adjacent to the lighting bulb for detecting the presence of objects in close proximity to the lighting bulb and producing a signal at the sensor output, wherein the detector further includes a plurality of infrared detectors which produce an infrared shield surrounding the lighting bulb, the detection system also including a safety controller attached to the sensor output for receiving the signal from the detector indicating that the object is present in close proximity to the bulb, the safety controller also having an output attached to the power switching device, wherein the safety controller output will direct the power switching device to remove power from its output when the detector detects the object in close proximity to the bulb.

14. The lighting fixture of claim 13 wherein the power switching device is a relay which passes power to the bulb when no objects are detected by the detection system and which removes power from the bulb when objects are detected by the detection system.

15. A safety lighting fixture for providing light to an area while also protecting from the danger of fire caused by heat generated by a lighting bulb, the fixture comprising:

a lighting fixture for holding and appropriately positioning the lighting bulb so as to cast light in a desired manner;

a power switching device attached to a main power supply for receiving a main power signal and controlling whether or not the main power signal is passed to a power output, the power output being attached to the lighting bulb so as to cause the bulb to be illuminated; and a detection system attached to the lighting fixture, the detection system including a plurality of sensing elements positioned adjacent to the lighting bulb for detecting the presence of objects in close proximity to the lighting bulb and producing a signal at the sensor output, wherein the detector further includes an optical signal source and a plurality of mirrors for creating a set of infrared beams which surround the lighting bulb, the detection system also including a safety controller attached to the sensor output for receiving the signal from the detector indicating that the object is present in close proximity to the bulb, the safety controller also having an output attached to the power switching device, wherein the safety controller output will direct the power switching device to remove power from its output when the detector detects the object in close proximity to the bulb.

16. The lighting fixture of claim 15 wherein the power switching device is a relay which passes power to the bulb when no objects are detected by the detection system and which removes power from the bulb when objects are detected by the detection system.

17. A safety system for use with a lighting fixture for protecting from the danger of fire caused by heat generated by a lighting bulb within the lighting fixture, the safety system comprising:

a power switching device attached to a main power supply for receiving a main power signal and controlling whether or not the main power signal is passed to a power output;

an emitter positioned adjacent to the lighting bulb;

a receiver also positioned adjacent the light bulb and in communication with the emitter, the receiver having an output for providing a signal indicative of the presence of the object between the emitter and the receiver; and a safety controller attached to the output of the receiver output and having an output attached to the power switching device, wherein the safety controller output will direct the power switching device to remove power from its output when the detector detects the object in close proximity to the bulb.

18. The lighting fixture of claim 17 wherein the power switching device is a relay.

19. The lighting fixture of claim 17 further comprising a plurality of infrared detectors which produce an infrared shield surrounding the lighting bulb.

20. The lighting fixture of claim 17 wherein the emitter is an infrared emitter.

21. The lighting fixture of claim 17 wherein the emitter is a Diode.

22. The lighting fixture of claim 17 wherein the emitter is an ultrasonic transducer.

23. The lighting fixture of claim 17 wherein the detector further comprises an optical signal source and a plurality of mirrors for creating a set of beams which surround the lighting bulb.

* * * * *